United States Patent [19]

Stenberg et al.

[11] 4,209,360

[45] Jun. 24, 1980

[54] TWO-SIDED DRAINAGE IN A ROLL-TYPE TWIN-WIRE FORMER

[75] Inventors: Erik G. Stenberg; Douglas Wahren, both of Karlstad; Carl Zotterman, Hammarö, all of Sweden

[73] Assignee: AB Karlstads Mekaniska Werkstad, Karlstad, Sweden

[21] Appl. No.: 10,742

[22] Filed: Feb. 9, 1979

[30] Foreign Application Priority Data

Feb. 15, 1978 [SE] Sweden ..... 7800775

[51] Int. Cl.[2] ..... D21F 1/10; D21F 11/00; D21F 1/40

[52] U.S. Cl. ..... 162/203; 162/301; 162/306; 162/DIG. 7

[58] Field of Search ..... 162/203, 211, 301, 306, 162/351, 357, DIG. 7

[56] References Cited

U.S. PATENT DOCUMENTS

| | | | |
|---|---|---|---|
| 3,017,928 | 1/1962 | Pedrick | 162/289 |
| 3,311,533 | 3/1967 | De Montigny et al. | 162/203 |
| 3,821,076 | 6/1974 | Stenberg et al. | 162/301 |
| 4,028,175 | 6/1977 | Schiel | 162/301 X |
| 4,113,556 | 9/1978 | Kankaanpaa | 162/301 X |
| 4,116,763 | 9/1978 | Stotz et al. | 162/301 |

*Primary Examiner*—Richard V. Fisher

*Attorney, Agent, or Firm*—Brumbaugh Graves Donohue & Raymond

[57] ABSTRACT

Methods and apparatus for producing a web by injecting a jet of stock between two tensioned wires and running the wires over a circumferentially grooved forming cylinder. The cylinder grooves and a zone immediately on the other side of the wires extending from the forming throat where the web is injected to the web run-off point are in direct, open communication with the ambient atmosphere so that water is drained inwardly and outwardly of the forming cylinder as the web is being formed. The jet stock size, wire speed and wire tension are adjusted in relation to the radius of the forming cylinder so that the inward and outward drainage of liquid from the web occurs in relative amounts sufficient to avoid substantial two-sidedness of the web thus produced.

30 Claims, 8 Drawing Figures

TWO-SIDED DRAINAGE IN A ROLL-TYPE TWIN-WIRE FORMER

BACKGROUND OF THE INVENTION

The present invention relates to methods and apparatus utilizing a roll type, twin wire former for producing a web. More particularly, it relates to methods and apparatus of this character which provide for simple and highly effective two-sided drainage of a jet of stock injected between two endless tensioned wires or foraminous belts adapted to run over a circumferentially grooved, rotatable forming cylinder.

For the sake of simplicity, the terms "wires" and "foraminous belts" will be used interchangeably herein. Thus, the word "wire" is intended to include not only conventional paper-making wires but also other kinds of foraminous belts used in web formers.

Roll type, twin wire formers have been used heretofore in which two-sided drainage has been achieved by employing forming cylinders designed as suction rolls. At high machine speeds, no water enters the interior of the forming cylinder, due to the resultant large centrifugal force, but it collects inside the shell and is expelled tangentially at the point where the wires between which the web is formed leave the forming cylinder. In such apparatus, the drainage is substantially more effective outwardly than inwardly of the forming cylinder. To prevent the paper web thus produced from exhibiting a pronounced two-sideness, it has been considered necessary to maintain inside the forming cylinder a vacuum substantially balancing the centrifugal force even at high machine speeds. However, the cost of such a forming cylinder does not favor its use and it has the disadvantage of producing a high sound level.

it has been proposed, therefore U.S. Pat. No. 4,028,175 (German Pat. No. 2,501,534), to use in place of a suction roll type of forming cylinder, a circumferentially grooved forming cylinder, and to balance the centrifugal force by providing a compressed air chest in the drainage zone, radially outside the forming cylinder and open towards it, to produce a counter-pressure increasing in steps in the direction of the forming cylinder. In this manner, it is said that the effect of the centrifugal force can be counterbalanced and even overcome by external compressed air. The intention is to obtain drainage that is symmetrical, of equal magnitude outwardly and inwardly, at every point in the drainage zone along the part of the forming cylinder over which the forming wires run. The bottoms of the circumferential grooves may be provided with holes to enable the air displaced by the water to escape into the cylinder. Also, the portion of the forming cylinder not in engagement with the running wires and the entire interior of the cylinder can be subjected to a vacuum from a save-all pan positioned at that portion of the forming cylinder. Such apparatus is also relatively expensive both in cost and in operation.

It has also been suggested that the web forming wires in the apparatus just described be led from the run-off point on the forming cylinder to a roll positioned under the cylinder, from which the inner wire relative to the forming cylinder (the outer wire relative to the roll) leaves at an early stage. This results in a detrimental partial adhesive of the wet web on the wrong wire and damage to the web from water expelled from the forming cylinder grooves and running through the inner wire. A doctor can be provided to eliminate web damage due to water but experience shows that it cannot be made efficient enough to prevent such damage.

SUMMARY OF THE INVENTION

The principal object of the present invention, accordingly, is to provide new and improved web forming methods and apparatus of the above general character in which effective two-sided drainage of a wet web sandwiched between two running wires is achieved in a simple and inexpensive manner such that the resulting web does not exhibit pronounced two-sidedness.

This is accomplished, accordiang to the invention, by maintaining atmospheric pressure in the circumferential grooves in the forming cylinder and on the opposite side of the stock or web sandwiched between the running wires, apart from any pressure influencing effects caused by rotation of the forming cylinder and the entry of water into, and its expulsion from, the grooves; storing in the grooves the water pressed thereinto during the contact of the forming wires with the forming cylinder, such water displacing the air in the grooves into the ambient atmosphere until the wires leave the cylinder, when the stored water is expelled; and by regulating the wire speed, the thickness of the jet, the forming cylinder radius and the wire tension in such fashion as to insure that the ratio of the stock drained inwardly of the forming cylinder to the stock drained outwardly of the forming cylinder will have an acceptable value as regards symmetry when the wires leave the forming cylinder.

To this end, both the circumferential grooves in the forming cylinder and a zone immediately on the other side of the wire extending from the forming throat where the web stock is injected to the web run-off point, as well as a save-all pan disposed in said zone and open towards the forming cylinder, are in direct, open communication with the ambient atmosphere. As a result, in operation the grooves and this zone are maintained substantially at atmospheric pressure, apart from pressure influencing effects attributable to rotation of the forming cylinder and the entry of water into and its expulsion from the cylinder grooves.

The grooves in the forming cylinder are designed with sufficient capacity to receive and store temporarily the drainage water pressed into them with displacement of the air contained therein, up to the point where the wires and sandwiched web leave the forming cylinder, where the stored water is expelled. Also, the radius of the forming cylinder is selected in relation to the headbox slice width, the wire speed, and the wire tension so as to provide a ratio of inwardly drained stock to outwardly drained stock that has an acceptable value as regards symmetry.

For standard paper grades, acceptable values of the ratio of inwardly drained stock to outwardly drained stock as regards symmetry lie in the range $1.0 \pm 0.5$. A lower value than 1.0 indicates that more stock is being drained outwardly than inwardly; a value greater than 1.0 indicates the opposite; and a value of exactly 1.0 indicates symmetrical drainage. However, the preferred lower limit is about 0.7 and the preferred upper limit less than about 1.3, suitably 1.0. The symmetry value can be increased by using an outer wire lower in openness than the inner wire.

By virtue of the features described above, the invention enables highly effective two-sided drainage to be produced in such fashion that the resulting web does not exhibit pronounced two-sidedness, even at very high machine speeds of the order of 33 m/s (approximately 2000 m/min.). This desirable result is achieved without the use of complicated and expensive apparatus for producing a vacuum inside the running wires (i.e., in the forming cylinder grooves) and/or pressure outside the wires. That a practical solution to the problem could be attained by simple means according to the invention without resort to the far more complicated measures previously considered necessary by experts in the art was totally unexpected.

The invention is based partly on the realization that, contrary to previous thinking, the drainage does not need to be symmetrical, i.e., equal in amount inwardly and outwardly of the forming cylinder, at every point on the drainage zone along the segment of the forming cylinder covered by the running wires, in order to produce the desired result. On the whole, it is not even necessary that as much stock shall have been drained inwardly as outwardly as of the time the running wires with the formed web therebetween leave the forming cylinder.

In practice, it is sufficient that, at the run-off point of the wires, the symmetry ratio, defined as the ratio of the inwardly drained stock to the outwardly drained stock, has a value of $1.0 \pm 0.5$, suitably between approximately 0.7 and 1.0, for pronounced web two-sidedness to be avoided. Of the most important of the parameters affecting the symmetry ratio, an increase of wire speed and/or thickness of stock jet will give a reduced value, while an increase in wire tension will result in an increased value. Also, as stated above, the use of an outer wire that is less open than the inner wire will increase the symmetry ratio.

The invention is also of utility in the production of paper grades such as paper towelling, etc., for which the requirement that pronounced two-sidedness must not occur is less essential. There, it permits the simplicity of the one-sided drainage process to be combined with a requirement for a larger drainage capacity than could be obtained with one-sided drainage. In the production of simple paper grades from furnishes that are fairly difficult to drain, the cross-sectional area of the grooves in the forming cylinder can be limited, so that a requisite drainage capacity is attained, whereas attainable even-sidedness of drainage is limited, at least for some basis weights, consistencies, etc.

This is illustrated most simply as follows: If the headbox can discharge a jet with a cross-sectional area twice as large as that of the total cross-sectional area of the grooves in the forming cylinder, there is no possibility of attaining symmetrical drainage. This can be done, however, if the slice opening of the headbox is reduced sufficiently. Such a limitation of attainable symmetry of drainage for certain operational conditions must not be considered to constitute any limitation whatsoever on the compass of the invention, but is entirely within its spirit and scope.

The invention also contemplates the provision of means for insuring that the web produced on the forming cylinder will be free of sheet defects resulting from problems in water handling and control of the ejection of water from the forming cylinder grooves that are likely to arise, particularly at high machine speeds.

To avoid damage caused by water expelled from the grooves in the forming cylinder, it is suitable in the method according to the invention that after drainage has taken place on the forming cylinder, the wires with the web in between are kept under tension and are led around a segment of break roll subtending an angle of at least about 1 radian. Desirably, the break roll should have a diameter at most equal to that of the forming cylinder and it should be located a short distance from the forming cylinder at least equal to the total thickness of the wires and web. Also, the web should be maintained under pressure against the break roll by means of the inner wire relative to the forming cylinder (the outer wire relative to the break roll), at least until this wire has passed through a horizontal plane containing the axis of rotation of the break roll.

Due to the wire tension, the relatively large wrap of the running wires on the break roll and the location of the break roll on the opposite side of the wires in relation to the forming cylinder, the web will be under pressure and protected against damage by water expelled from the forming cylinder grooves. Since the break roll preferably also has a smaller diameter than the forming cylinder, the web is subjected to additional drainage caused by the wire tension during its passage over the break roll. As the web has already been formed, this additional draingage does not contribute to two-sidedness of the web.

To avoid damage to the web when the wires separate from each other, it is suitable in the method and apparatus according to the invention to use a break roll having a smooth surface and at the break roll to separate the outer wire thereon from the web and the other wire at a small separation angle not exceeding about 10°. Alternatively, the wires with the web therebetween may be led from the break roll over a separation roll with a smooth surface and located on the same or the opposite side of the wires relative to the break roll. At the separation roll, the outer wire thereon may be separated from the web and the other wire at a small separation angle not exceeding about 10°. In both cases, the separation angle should preferably be between about 1.5° and about 3°.

Splashing at the separation of the wires, which could cause degrading damage to the web, may suitably be avoided by using for the wire that is separated from the web and the other wire a wire of single-layer type and of sufficiently fine mesh to hold at a portion thereof located immediately preceding the point of separation no more water than can be absorbed on separation in an adjacent identical portion of the web, increased by the quantity of water that passes on separation from said wire portion through said web portion. Also, the other wire of the pair should be chosen to produce hydraulic contact between the web and the smooth shell surface on which the separation takes place.

Water transport may be facilitated suitably in the method and apparatus according to the invention by letting the wires with the web in between leave the forming cylinder in its lower descending quandrant, because then gravity will assist in producing a concentrated ejection from the grooves in the forming cylinder. Alternatively, the wires with the web in between may be disposed to leave the forming cylinder in its upper ascending quandrant, in which event, however, a certain minimum speed in required to keep the ejection concentrated.

For the large drainage capacity offered by the invention to be utilized, it is suitable that the portion of the outer wire relative to the forming cylinder that follows the cylinder contour subtend an angle of between about $\Pi/2$ and about $\Pi$ radians, and that the several rolls supporting the running wires be located in such manner that this condition obtains.

DESCRIPTION OF REPRESENTATIVE EMBODIMENTS

The invention may be better understood from the following detailed description of several embodiments, taken in conjunction with the accompanying drawings, in which.

Figure 1:
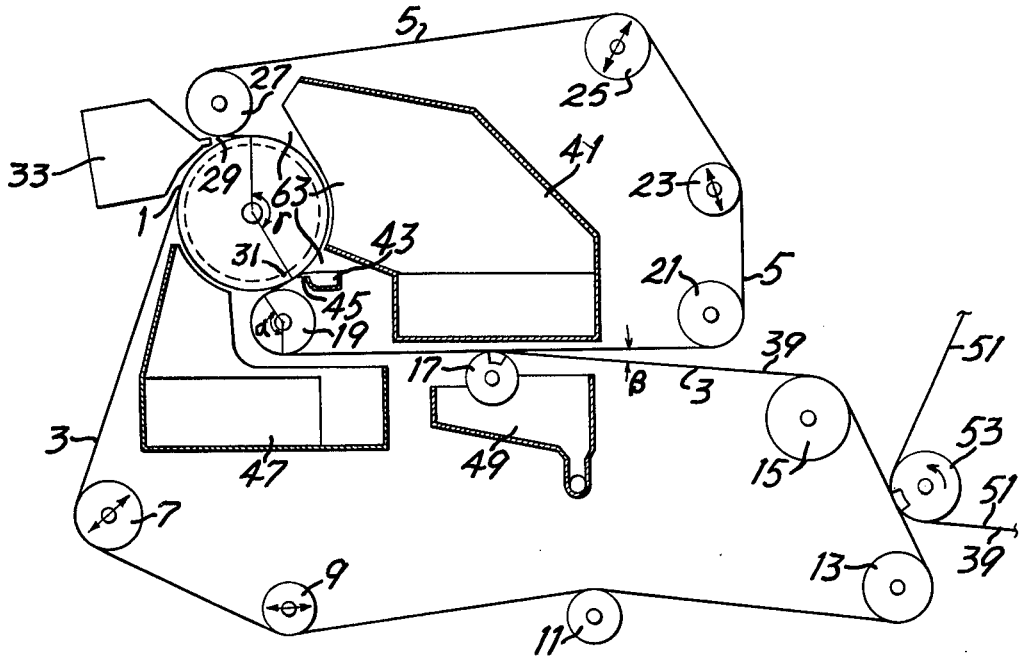
FIG. 1 is a schematic side view of a roll type twin-wire former designed and operating according to a first preferred embodiment of the invention.
Figure 4:
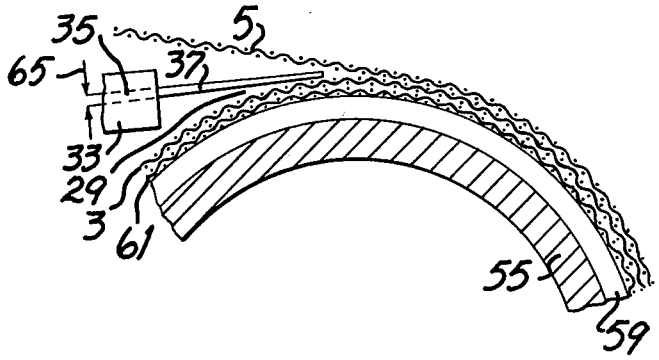
FIG. 4 is a view in vertical cross-section through the forming throat defined by the two converging forming wires and an adjacent part of the forming cylinder.

The roll type twin-wire former shown in FIG. 1 comprises a rotatable forming cylinder 1 grooved substantially circumferentially about the periphery thereof, and two endless wires or similar foraminous belts, namely, an inner wire 3 and an outer wire 5. The wires 3 and 5 are suitably supported to form a converging, web forming throat 29 therebetween substantially tangential to the shell surface of the forming cylinder 1, as best shown in FIG. 4, then to run together over part of the periphery of the forming cylinder 1 in the direction of rotation to a run-off point 31, where they leave the cylinder together.

Preferably, the outer wire 5 runs over a portion of the periphery of the forming cylinder 1 that subtends an angle $\gamma$ between $\Pi/2$ and $\Pi$ radians. To this end, the wire 3 is supported by a plurality of rotatable rolls 7, 9, 11, 13, 15, 17 and 19, and a plurality of rotatable rolls 21, 23, 25 and 27 support the wire 5. While rotatable rolls are employed to support the wires 3 and 5 in the embodiment shown in FIG. 1, it is, of course, within the scope of the invention to use in place of one or more of these rolls stationary elements of the kinds well known in paper machinery engineering, such as, for example, foils, foil boxes, suction boxes, wire tables, etc.

At least two of the support rolls, namely, the roll 7 for the inner wire 3 and the roll 25 for the outer wire 5, are stretch rolls by means of which the wires 3 and 5 can be put under tension. Usually a higher wire tension is used for the outer wire 5 than for the inner wire. Guide rolls 9 and 23 are provided for the inner and outer wires 3 and 5, respectively, together with a separation roll 17 for separating the wires, a break roll 19 common to both wires, and a breast roll 27 for the outer wire 5.

A headbox 33 has an outlet 35 (FIG. 4) arranged to inject a jet of stock 37 into the forming throat 29 between the wires 3 and 5. As the wires 3 and 5 run over the rotating forming cylinder 1 from the forming throat 29 to the run-off point 31, the discharged stock is drained two-sidedly, i.e., inwardly towards the forming cylinder 1 and outwardly away from the forming cylinder 1, as a result of the pressure exerted by the wires during formation of a web 39 therebetween.

A first save-all pan 41 is provided for catching and draining off a major portion of the water which is first pressed outwardly through the outer wire 5 as the web runs from the inner portion of the forming throat 29 to shortly before the run-off point 31, and is then expelled by centrifugal force. A doctor or foil 45 at or immediately before the run-off point 31 makes light contact with the outer fabric of the wire 5 in order to scrape off any drops of water not expelled therefrom. The foil 45 doctors off any water adhering to the surface of the outer fabric and also deflects this water and any water drops into a save-all pan. This insures good and clean contact between the fabric-web-fabric sandwich and the break roll, and prevents damage to the web, which might otherwise be caused by drops or pools of water being pressed into or through the web by the pressure between the break roll and the sandwich.

A second pan 47 is arranged to catch and drain off the water that is first pressed inwardly through the inner wire 3 and is then retained in the circumferentially grooved forming cylinder 1 up to the run-off point 31, where it begins to be thrown out from the forming cylinder 1.

From the run-off point 31, which in the embodiment shown in FIG. 1 is in the lower descending quadrant of the forming cylinder 1, the wires with the web between them run to the break roll 19, which preferably has a smooth surface and a smaller diameter than the forming cylinder 1. The break roll 19 is located a short distance away from the forming cylinder 1 at least equal to the total thickness of the wires and the web, and at the five o'clock position with respect to clockwise rotation of the forming cylinder 1. Further, it is located on the opposite side of the wires in relation to the forming cylinder 1 so that the path of the wires around the forming cylinder 1 and the break roll 19 is S-shaped and the inner wire 3 becomes the outer while the outer wire 5 becomes the inner relative to the break roll 19.

The wires 3 and 5 follow a segment of the periphery of the break roll 19 subtending an angle $\alpha$ of at least about 1 radian (more than 2 radians in the embodiment shown in FIG. 1) and the inner wire 3 (which here constitutes the outer wire) maintains the web under pressure against the break roll 19 at least until the wire 3 has passed downwardly through a horizontal plane containing the axis of rotation of the break roll 19. As the break roll 19 preferably has a smaller diameter than the forming cylinder 1, the tension in the inner wire 3 (which here constitutes the outer wire) will subjject the web to a greater pressing action than that at the forming cylinder 1.

The water pressed outwardly through the inner wire 3 is ejected by centrifugal force which, due to the relatively long wrap of the wires on the break roll, acts for a sufficiently long time for the increased drainage pressure to be utilized. The water thus ejected passes out of the inner wire 3 and is caught by the second pan 47.

In FIG. 1, the wires 3 and 5 run from the lowest point of the break roll 19 substantially horizontally to the separation roll 17. This roll is shown as a suction roll but is preferably a roll with a smooth surface and is preferably located, as shown, on the opposite side of the wires in relation to the break roll 19. The outer wire 5, which here has become the outside wire again, is separated on the separation roll 17 from the web 39 and the inner wire 3 at a small separation angle $\beta$ not exceeding about 10°. The angle $\beta$ should preferably be between about 1.5° and about 3°.

Preferably, the wire or fabric which is separated from the web and the other wire, i.e., the outer wire 5 in the embodiment shown in FIG. 1, is of single-layer design and of sufficiently fine mesh to retain at a portion immediately before the point of separation no more water than the quantity that can be absorbed at separation in an adjacent identical portion of the web 39, increased by the quantity that passes from said wire portion through said web portion upon separation. In addition, the second wire or fabric, i.e., here the inner wire 3, preferably should be selected to produce hydraulic contact between the web 39 and the smooth surface on which the separation takes place, i.e., here the surface of the separation roll 17. A third pan 49 is arranged under the separation roll 17 to catch and drain off water that passes downwardly through the inner wire 3 at separation.

From the separation roll 17, the outer wire 5 runs over the roll 21, the guide roll 23, the stretch roll 25 and the breast roll 27 and returns to the forming cylinder 1. All of the rolls 19, 21, 23, 25 and 27 and the first save-all pan 41 are located inside the loop formed by the outer wire 5. In the embodiment shown in FIG. 1, the breast roll 27 is located approximately at the eleven o'clock position with respect to clockwise rotation of the forming cylinder 1, at a relatively short distance from the forming cylinder 1.

For high speed operation, the breast roll 27 may be located earlier, for instance, at the ten o'clock position, which serves to increase the available drainage length on the forming cylinder 1 without introducing any ill side effects. For very low speed operation, where the drainage capacity of the former is usually large in comparison to the requirements, the breast roll 27 may be, and preferably should be, located closer to the twelve o'clock position in order to prevent the back-flow of water drained through the outer fabric 5 which, due to the low speed of the former and fabric, has insufficient kinetic energy to spurt clear of the top of the forming roll 1 into the save-all 41.

Further, the inner wire 3 runs from the separation roll 17 over the rolls 15, 13 and 11, the guide roll 9, and the stretch roll 7, back to the forming cylinder 1. The web 39 is carried on the top of the inner wire 3 from the separation roll 17 to a point between the rolls 15 and 13, where it is picked up from the inner wire 3 by an endless loop of a pick-up wire or felt 51 by means of a suction roll 53 and is conveyed, as a rule, to a press section and possibly further to a dryer section. The forming cylinder 1 and the second and third pans 47 and 49, together with the stretch roll 7, the lead roll 9, the rolls 13 and 15, and the separation roll 17, are all located inside the loop formed by the inner wire 3, while the roll 11 is located outside the loop.

Figure 2:
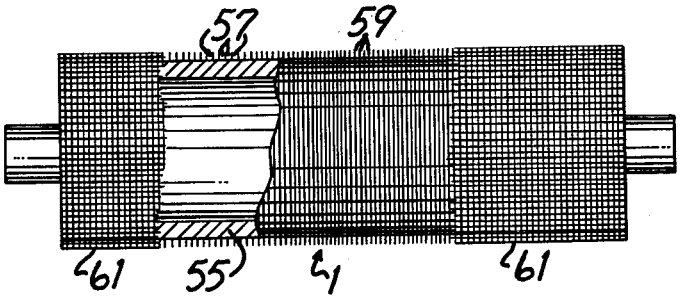
FIG. 2 is a front view, partly in section, of a forming cylinder for use in the twin-wire former shown in FIG. 1.
Figure 3:
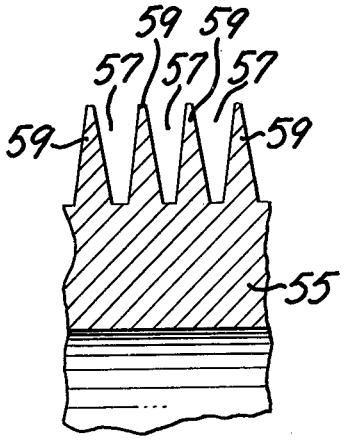
FIG. 3 is a view in vertical longitudinal section through part of the forming cylinder and shows a form of groove design to an enlarged scale.

As shown in FIGS. 2 through 4, the forming cylinder 1 comprises principally a cylindrical shell 55, on the outside of which are formed a plurality of annular, peripheral grooves 57. The grooves 57 are separated from each other by annular ridges 59, over which at least one coarsemesh wire cloth sleeve 61, e.g. a shrink sleeve, is fitted. The ridges 59 are suitably the only supporting elements for the wire sleeve 61. Any supporting elements for the wire sleeve 61 which extend across the grooves 57 and which are high in a radial direction compartmentalize the grooves and must not be used as they could cause problems. In particular, they limit the free flow of air out of and into the grooves during the forming process.

The grooves 57 and the space 63 located immediately on the other side of the wires 3 and 5 and extending between the forming throat 29 and the run-off point 31, as well as the first save-all 41, are in open, direct communication with the ambient atmosphere. Apart from any pressure influencing effects caused by the rotation of the forming cylinder 1 and the pressing-in and expulsion of water from the grooves 57, during operation of the former, atmospheric pressure will be maintained in the grooves 57 and in the space 63 on the opposite side of the stock or web pressed between the wires 3 and 5. Further, the grooves 57 have sufficient volume to receive and store water pressed into them upon drainage, any air present therein being displaced to the ambient atmosphere, until the wires 3 and 5 with the web therebetween leave the forming cylinder 1 at the run-off point 31, so that expulsion of water from the grooves 57 can take place.

In the embodiment shown in FIG. 3, the ridges 59 are integral with the shell 55 and have a converging parallel-trapezoidal sectional shape from root to crest. Under normal drainage conditions, the ridges 59 can have a height of approximately 25 mm, a width at the root of approximately 8 mm and at the crest approximately 1 mm, and they can be arranged with a pitch of approximately 10 mm, so that if a symmetry ratio of 1.0 is required, the slice opening 65 of the headbox 33 must not exceed approximately 13 mm. The ridges may, of course, be separately manufactured and subsequently fitted on to the shell. Also, the ridges can be rectangular in cross-section with a width of, for example, between 2 and 3 mm, with unchanged height and pitch.

Further, the shell of the forming cylinder can be reinforced by internal, transverse discs (not shown) and it can be made with a core of relatively inexpensive material such as structural steel, for example, having an outer sleeve suitably fitted thereon in which the grooves have been produced by machining. The outer sleeve may comprise a more expensive, non-corrosive material, such as bronze or a suitable grade of stainless steel, or rubber or plastic. If only a marginal increase of drainage capacity is required over that obtainable with one-sided drainage, the ridges can be made of wire of circular cross-section, for example. In fact, the warp wires of the wire sleeve 61 may be used for this purpose when the meshes of the wire sleeve are suitably extended in the circumferential direction of the forming cylinder 1.

To avoid a pronounced two-sidedness of the web produced, according to the invention, the radius of the forming cylinder 1 is made sufficiently large, and the wire tension, degree of openness of the outer wire relative to the inner wire, jet thickness or slice opening and wire speed are suitably selected to give a symmetry ratio, defined as the ratio of inwardly-drained stock to outwardly-drained stock, in the range of $1.0 \pm 0.5$, suitably betwen approximately 0.7 and 1.0.

Since the embodiments shown in FIGS. 5, 6, 7 and 8 incorporate the same basic principles as the form of the invention shown in FIGS. 1–4, corresponding elements in the description below are designated by corresponding reference numerals in the 100, 200, 300 and 400 series, respectively, for FIGS. 5, 6, 7 and 8. Taking into consideration the essential similarities between the different embodiments, in principle only the most obvious differences and certain similarities will be described below.

Figure 5:
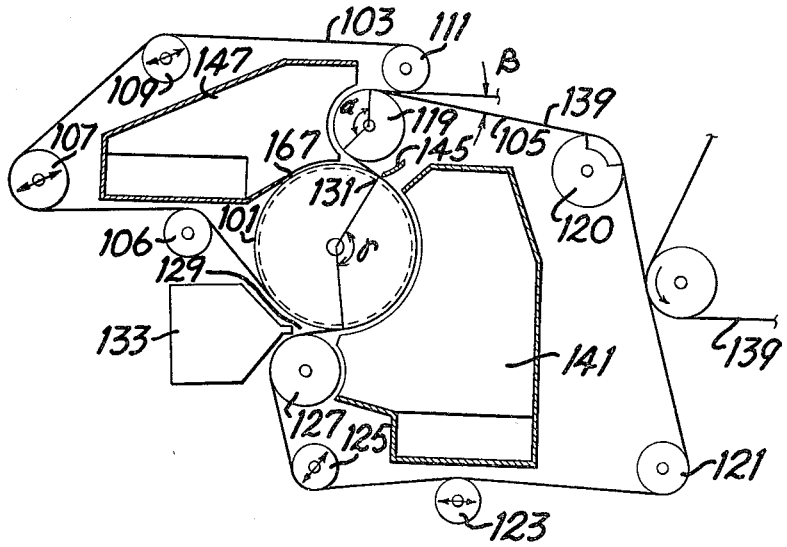
FIGS. 5, 6 and 7 are schematic side views of three roll type twin-wire formers designed and operating according to second, third and fourth embodiments of the invention.

The roll type twin-wire former shown in FIG. 5 is a primary former, similar to that shown in FIGS. 1–4, but differs therefrom primarily in that the breast roll 127 for the outer wire 105, the forming throat 129 and the headbox 113 are all located underneath the forming cylinder 101. The run-off point 131 at which the wires 103 and 105 with the web 139 in between leave the forming cylinder 101 is located in the upper ascending quadrant of the forming cylinder 101. The break roll 119 is located above the forming cylinder 101, and the breast roll 127 and the break roll 119 are located approximately at the seven o'clock and one o'clock positions, respectively, of the forming cylinder 101 as it rotates in the clockwise direction.

As in the case of FIG. 1, a rubber doctor 145 is positioned at or slightly before the run-off point 131 and in contact with the outer wire 105, or a wire doctor, not shown, is provided after the run-off point 131 with light pressure against the free fabric run. In addition, a second rubber doctor 167, supported by the second save-all 147, is disposed in contact with the wire sleeve of the forming cylinder 101. Separation of the wires 103 and 105 takes place on the break roll 119, which has a smooth surface. The inner wire 103, which is in the outer position on the break roll 119 is separated from the web 139 and the underlying outer wire 105 at a small separation angle $\beta$. Naturally, the other features stated previously for contributing to a trouble free separation are also suitably applied, taking into consideration that the single-layer wire is here the inner wire 103.

The forming cylinder 101 and the second save-all 147, together with the stretch roll 107, the guide roll 109 and the fly roll 111, are all located inside the loop formed by the inner wire 103, while a roll 106 arranged between the stretch roll 107 and the forming cylinder 101 is located outside this loop. The wrap of the wires on the forming cylinder 101 and the break roll 119 is unchanged as compared with FIG. 1.

Figure 6:
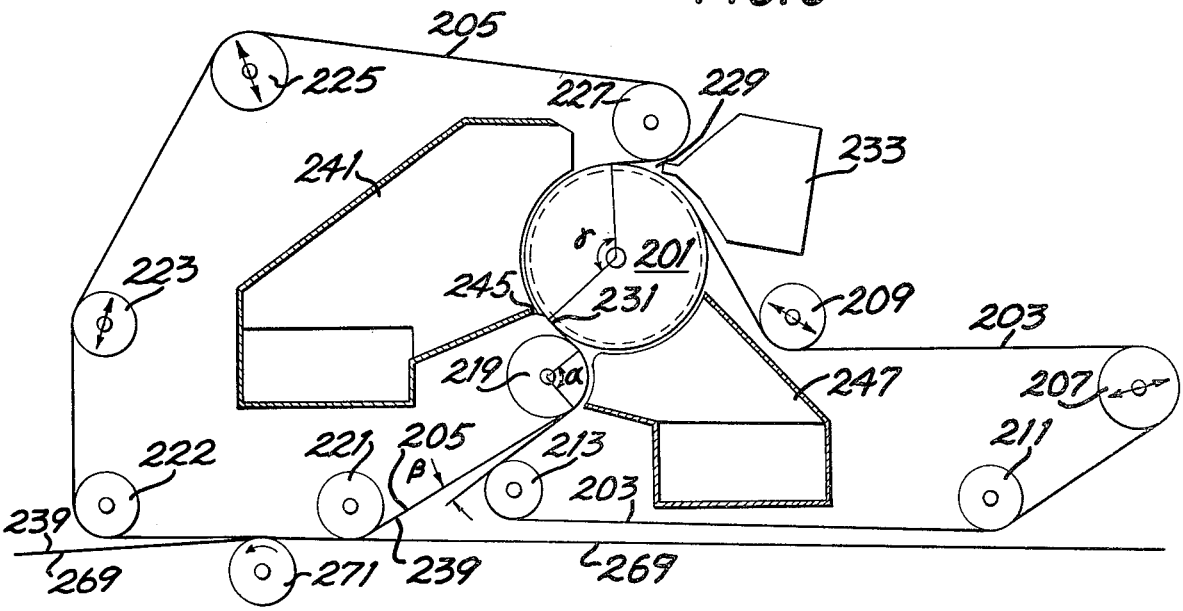

The roll type twin-wire former shown in FIG. 6 is a secondary former or top former, as distinguished from those shown in FIGS. 1 through 4 and 5. The web produced in this former is intended to be couched together with at least one other separately produced web to form a multi-layer web. The separately produced web can have been made, for example, in one of the twin-wire formers shown in FIGS. 1 through 4 and 5. It is within the scope of the invention, however, to use a multi-layer headbox delivering a stratified jet or at least two substantially parallel or slightly converging jets so that a multi-layer web is obtained directly with any one of the formers herein described.

In the embodiment shown in FIG. 6, which is reversed in comparison with the two other embodiments shown, the breast roll 227 for the outer wire 205, the forming throat 229 and the headbox 233 are again located above the forming cylinder 201, and the run-off point 231 is in the lower descending quadrant of the forming cylinder 201. The break roll 219 is located below the forming cylinder 201, and the breast roll 227 and the break roll 219 are located approximately at the one o'clock and seven o'clock positions, respectively, of the forming cylinder 201 as it rotates in the counterclockwise direction. As in the case of FIG. 1, a rubber doctor 245 is positioned in contact with the outer wire 205 at or slightly before the run-off point 231, but this is supported here by the first save-all 241. Alternatively, a wire doctor, not shown, may be substituted for the rubber doctor 245 and arranged to press lightly against the free fabric run after the run-off point 231.

Separation of the wires 203 and 205 takes place on the break roll 219, which has a smooth surface. The inner wire, which is in the outer position on the break roll 219, is separated from the web 239 and the underlying outer wire 205 at a small separation angle $\beta$, most conveniently adjusted by means of the fly roll 213. Also, the other features stated in conjunction with the description of the first embodiment for contributing to a trouble free separation are suitably applied.

The wrap angle $\alpha$ subtended by the part of the break roll 219 covered by the wires 203 and 205 is less than for the other two embodiments described above, but it is still at least approximately 1 radian. Also, separation takes place as in the case of FIG. 5 only after the inner wire 203 in the direction of rotation of the break roll 219 has passed a horizontal plane containing the axis of rotation of the break roll 219.

As distinguished from the two other embodiments described, the web 239 in FIG. 6 is conveyed obliquely downwardly from the break roll 219, suspended on the underside of the outer wire 205. The outer wire 205 then runs around the bottom of the roll 221 and continues in a substantially horizontal run with the web 239 still sticking to its underside in a direction towards the bottom of a roll 222. Underneath the actual twin-wire former is disposed an endless conveyor wire or felt 269, the run of which is substantially horizontal and the top side of which carries a web separately produced in another former.

A roll 271, positioned between, but below, the rolls 222 and 221, lifts the conveyor wire or felt 269 into contact with the web 239 suspended on the underside of the outer wire 205 so that the web 239, due to pressing and table roll action, is transferred from the outer wire 205 to the conveyor wire or felt 269. The conveyor wire or felt with the web 239 on it is separated at a small angle $\beta$ from the outer wire 205.

The forming cylinder 201 and the second save-all 247, together with the stretch roll 207 and the rolls 211 and 213, are all located inside the loop formed by the inner wire 203, while the guide roll 209 is located outside the loop and, in the direction of travel of the wire 203, between the stretch roll 207 and the forming throat 229. Inside the loop formed by the outer wire 205 are located the first save-all 241, the break roll 219, the rolls 221 and 222, the guide roll 223, the stretch roll 225, and the breast roll 227. The wrap angle $\gamma$ subtended by the part of the forming cylinder 201 covered by the wires 203 and 205 is the same as in FIG. 5, and is between about /2 and about radians.

Figure 7:
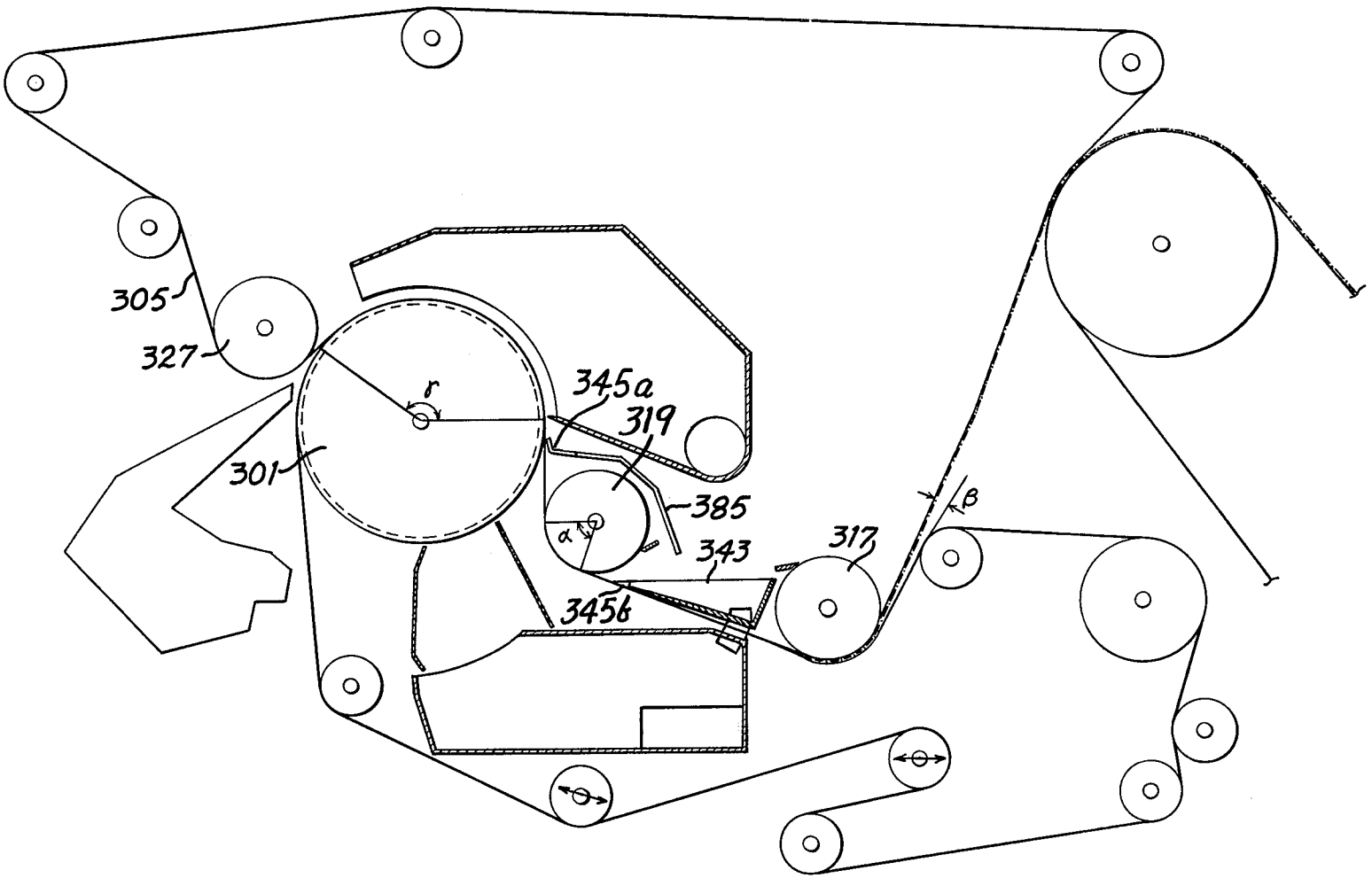

In FIG. 7, the wire-web-wire sandwich has a generally vertical (say $\pm 20°$) and substantially straight run from the forming cylinder 301 to the break roll 319. This configuration has no adverse effects at high speeds but facilitates water handling at low speeds, thereby making it possible to run the former at lower speeds than were possible heretofore, thus widening its useful range of speed. At low speeds, the breast roll 327 for the outer wire 305 may be moved from the position shown along the periphery of the forming cylinder to a position closer to a vertical plane containing the axis of the forming cylinder.

The generally vertical run from the forming cylinder to the break roll is preferred not only for the configurations shown in FIGS. 1 and 6 but also for the inverted configuration shown in FIG. 5. Due to the earth's gravitation, water handling is easier with a downward run than with an upward run, so a generally downward run is preferred.

The distance between the forming cylinder 301 and the break roll 319 should be large enough to accommodate a conventional foil member 345a for scraping surface water off the outer wire 305 and a water chute 385 connected thereto for conducting the water to a save-all 343 in order to avoid crushing of the web as it passes around the break roll 319. The save-all 343 is small and substantially wedge-shaped and it is located between the break roll 319 and the separation roll 317. Crushing of the web at the separation roll 317 is avoided by a second foil member 345b mounted at the leading edge of the save-all 343. The separation roll 317 is located within the loop of the outer wire.

Figure 8:
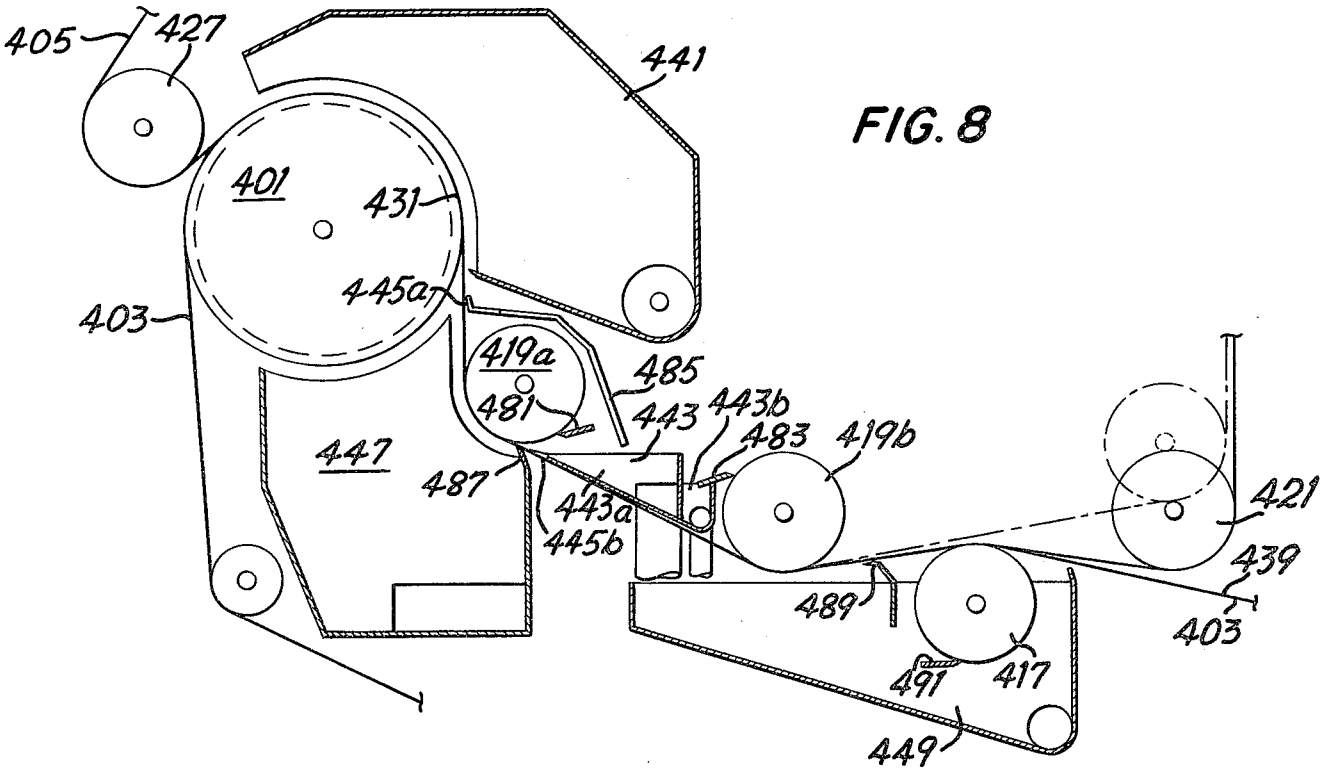
FIG. 8 illustrates schematically a preferred embodiment of the invention.

The former shown in FIG. 8, which is the preferred embodiment, differs from that shown in FIG. 7 primarily in having a second break roll 419b located substantially at the position of the separation roll 317 of FIG. 7 but at a lower level and a greater distance from the first break roll 419a so as to make room for a larger save-all 443 therebetween. The two break rolls together have a total wrap angle of at least 1 radian. The separation roll 417 is located at a position within the loop of the inner wire 403 such that the wire-web-wire sandwich runs from the bottom side of the second break roll 419a slightly upwardly to the top side of the separation roll 417, where the outer wire 405 is separated at a small angle from the web 439 and the inner wire 403. From thence, the outer wire 405 runs slightly downwardly over the bottom side of a subsequent roll 421 while the separated inner wire 403 with the web 489 thereon passes below.

The roll 421 is adjustable such that it may be located in any one of two major positions shown in full and dotted lines in FIG. 8. In the full line position of the roll 421, the roll 417 acts as the separating roll, pulling the web down by table roll action so that the web follows the inner fabric 403 to further processing. With the roll 421 in the dotted line position, the break roll 419b acts as a separator roll, separating the two fabrics at a small angle, less than 10° and preferably in the range 1.5° to 3°, such that the web follows the outer fabric 405, its position being shown in dotted lines in FIG. 8, for further processing. This versatility of web handling may be put to efficient use in special applications. Normally, however, the arrangement will be such that the web always follows one fabric or the other without fail.

As in FIG. 7, a doctor or foil member 445a is carried by the chute 485 and another doctor or foil member 445b in wiping engagement with the outer wire 405 is mounted at the leading edge of the wedge-shaped save-all 443. In addition, a blade member 487 is provided between the first break roll 419a and the doctor or foil member 445b, and a doctor or foil member 489 is provided between the second break roll 419b and the separation roll 417, both in wiping engagement with the inner wire. The blade member 487 is mounted at the rear wall of a lower main save-all 447 for collecting water thrown out from the grooves of the forming cylinder 401.

The upper secondary wedge-shaped save-all 443 is divided into a leading portion 443a for collecting water from the chute 485 and water scraped off the surface of the first break roll 419a by means of a first doctor blade 481, and a rear portion 443b for collecting water scraped off the surface of the second break roll 419b by means of a second doctor blade 483. The two portions 443a and 443b discharge through conduits into a lower secondary save-all 449 located below the second break roll 419b and the separation roll 417. The lower secondary save-all 449 also collects water from the doctor or foil member 489 and water scraped off the surface of the separation roll 417 by a third doctor blade 491.

The chute 485 may be dispensed with if the bottom wall of the upper main save-all 447 is lowered and the first foil member 445a is mounted in such a position that the water separated from the wire-web-wire sandwich by the latter is collected in the upper main save-all.

The water handling and other arrangements shown in FIG. 8 are capable of satisfying fully the demand for a simple twin-wire former with a very wide range of speeds. Simply relocating the breast roll 427 from the ten o'clock position shown to a position close to twelve o'clock converts the former from a high speed machine capable of operating up to speeds as high as the drainage capacity of the former will allow for any particular furnish, basis weight and headbox consistency, to one which can run at very low speeds indeed.

The effectiveness of the methods and apparatus of the invention will be readily apparent from the illustrative data relating to web forming under different operating conditions given in Table I, in which $h_o$ is the thickness of stock jet, $c_w$ the wire speed, $c_j$ the velocity of the stock jet, K the consistency of stock, T the wire tension, R the radius of forming cylinder, and S the symmetry ratio. The openness of the wire was 20% in all cases.

TABLE I

| Run | $h_o$ m | $c_w$ m/s | $c_j$ m/s | K % | T N/m | R m | S |
|---|---|---|---|---|---|---|---|
| A | 0.01 | 16.7 | 17.8 | 0.49 | 5900 | 0.54 | 0.85 |
| B | 0.005 | 16.7 | 17.8 | 0.49 | 5900 | 0.54 | 0.90 |
| C | 0.013 | 10.7 | 11.7 | 0.41 | 5900 | 0.54 | 0.93 |
| D | 0.01 | 20.8 | 21.3 | 0.44 | 5900 | 0.54 | 0.80 |
| E | 0.008 | 33 | 35 | 0.30 | 11800 | 0.54 | 0.78 |
| F | 0.008 | 33 | 35 | 0.30 | 11800 | 1.08 | 0.79 |
| G | 0.008 | 33 | 35 | 0.30 | 23600 | 1.08 | 0.88 |
| H | 0.016 | 33 | 35 | 0.30 | 23600 | 1.08 | 0.75 |

The data in Table I indicate that, despite a high wire speed, 33 m/s (approximately 2000 m/min), it is possible to obtain an almost symmetrical sheet that does not exhibit any noticeable two-sidedness, without the aid of vacuum on the inside or pressure on the outside when forming the web, and by using a high wire tension. A comparison of Runs F and G shows that an increase of wire tension is capable of increasing a symmetry ratio that is already high, and on comparing Runs G and H, it can be seen that a doubling of stock jet thickness, e.g. to double the basis weight, caused the symmetry ratio to diminish from 0.88 to 0.75. If a reduction in the value of the symmetry ratio cannot be accepted when an increase of basis weight is desired, and the wire tension cannot be increased, an increase of stock consistency must be made, and this will not affect the symmetry ratio.

The illustrative embodiments described above and shown on the drawings are susceptible of variations and modifications within the scope of the invention. For example, the break roll 19 in FIG. 1 can have an open shell surface instead of a smooth shell surface. Such an open surface can be blind-drilled or grooved and also be formed of several wire sleeves shrink fitted one on the other. The save-all 43 with doctor 45 can then be moved down until the doctor is in contact with or at a very short distance from the topside of the outer wire 5 at its substantially horizontal run immediately downstream of the break roll 19. The water accompanying the outer wire 5 from the run-off point 31 on the forming cylinder will pass inside the open surface of the break roll 19 and cause no damage to the web pressed between the wires 3 and 5, and the water expelled is collected by the repositioned doctor 45 and drained off to the save-all 43. For low machine speeds, the repositioned doctor 45 can suitably be a suction doctor.

It is also possible to replace the break roll 19 together with the save-all 43 and the doctor 45 by a save-all pan located in the break roll 19 position and provided with a curved wall arcuately shaped in the vertical section with a convex outside over which the outer wire 5 runs and which corresponds to the part of the fly roll 19 wrapped by the wire (subtending the angle $\alpha$). The suitably concave inside of the save-all would catch the water accompanying the outer wire 5 on the side facing the save-all. Such a save-all wound be included in the wire supporting means.

The circumferential grooves 57 in the forming cylinder 1, instead of running exactly in planes normal to the machine axis, may run in planes forming a small angle to the normal to the machine axis. Also, the grooves 57 may form a helix of suitable pitch around the forming cylinder. If desired, the grooves 57 can start in the middle of the forming cylinder and extend outwardly as helices towards the ends of the cylinder in such a way that when the former is operating, a lateral spreading of the wires will be obtained on the forming cylinder.

In addition, both the grooves 57 and the ridges 59, instead of being exactly straight, can be sinusoidal to zigzag-shaped in the circumferential direction, whereby the cylindricity of the wire sleeve 61 is improved. The amplitude of the sinusoidal or zigzag curve can be so great in relation to the pitch that lookthrough in the circumferential direction of the grooves is obstructed, but this is not usually necessary in order to prevent any marks on the web. The width of the grooves should be mainly constant, but the ridges need not be arranged so that an amplitude peak on one ridge and the nearest peak with corresponding orientation on an adjacent ridge are in a direction parallel to the longitudinal axis of the forming cylinder.

In some cases, it may be advantageous for the ridges to be slightly displaced from each other in the circumferential direction, so that the peak-to-peak direction forms a small angle with the longitudinal axis of the forming cylinder. Such curved grooves and ridges are most easily produced by molding a flat sheet of rubber or plastic provided with undulating grooves and ridges and attaching this sheet to the surface of the cylinder.

Other modifications in form and detail will be apparent to those skilled in the art. All such modifications are intended to be encompassed within the scope of the following claims.

We claim:

1. In a method of producing a web from a jet of stock injected between a pair of tensioned forming wires run around a peripheral segment of a forming cylinder having multiple circumferential grooves formed in the periphery thereof, the improvement comprising the steps of maintaining the cylinder grooves and a zone outside said wires and adjoining said peripheral segment in open, direct communication with the ambient atmosphere such that part of the liquid in the web drains outwardly as the wires run over said peripheral segment, and part is pressed inwardly into said cylindrical grooves with displacement of the air therein into the ambient atmosphere and is expelled from the grooves as the wires leave the forming cylinder, solely in response to forces resulting from translation and compression of the web by the forming wires as they are run around said peripheral segment, and adjusting the wire speed and tension, and the thickness of the injected jet in relation to the radius of the forming cylinder to achieve a ratio of inwardly drained liquid to outwardly drained liquid that will result in the production of a web without pronounced two-sidedness.

2. A method as defined in claim 1 in which the ratio of inwardly drained liquid to outwardly drained liquid lies in the range $1.0 \pm 0.5$.

3. A method as defined in claim 2 in which the outer wire, in running over the forming cylinder subtends an angle between about $\Pi/2$ and about $\Pi$ radians.

4. A method as defined in claim 3 in which the forming wires with the web therebetween are run off the forming cylinder substantially in the vertical direction.

5. A method as defined in claim 4 in which the forming wires with the web therebetween leave the forming cylinder at a location in its lower descending quadrant.

6. A method as defined in claim 4 in which the forming wires with the web therebetween leave the forming cylinder at a location in its upper ascending quadrant.

7. A method as defined in any one of claims 5 and 6 in which the wires, upon leaving the forming cylinder, are run over a peripheral segment of a break roll located away from the forming cylinder a short distance at least equal to the total thickness of the forming wires with the web therebetween, said peripheral segment subtending an angle of at least about 1 radian.

8. A method as defined in claim 7 in which the break roll has a smooth surface and the outer wire relative to the break roll is separated on that roll from the web and the other wire, the separation angle being less than about 10°.

9. A method as defined in claim 7 in which the wires with the web therebetween, after leaving the break roll, are run over a smooth surfaced separation roll and the outer wire relative to the separation roll is separated thereat from the web and the other wire at a small angle less than about 10°.

10. A method as defined in claim 8 in which the separation angle is between about 1.5° and about 3°.

11. A method as defined in claim 9 in which the separation angle is between about 1.5° and 3°.

12. A method as defined in claim 11 in which the separation roll is located on the opposite side of the wires relative to the break roll.

13. A method as defined in claim 11 in which the separation roll is located on the same side of the wires as the break roll and surface water is removed from the outer wire at locations between the forming cylinder and the break roll and between the break roll and the separation roll.

14. A method as defined in claim 4 in which the wires, upon leaving the forming cylinder, are run over a peripheral segment of a break roll located away from the forming cylinder at least equal to the total thickness of the forming wires with the web therebetween, then over a peripheral segment of a second break roll spaced apart from said first break roll in the direction of movement of the web, and then over a smooth surfaced separation roll at which the outer wire relative to the separation roll is separated from the web and the other wire at a separation angle not exceeding about 10°.

15. A method as defined in claim 14 in which the angles subtended by the peripheral segments of the first and second break rolls total at least about 1 radian, the separation angle is between about 1.5° and about 3°, surface water is removed from the outer wire at locations between the forming cylinder and the first break roll and between the first and second break rolls, and surface water is doctored off the first and second break rolls and the separation rolls.

16. In apparatus for forming a web comprising a rotatable forming cylinder having multiple circumferential grooves formed in the periphery thereof, a pair of endless forming wires, means for supporting said wires so that they converge to form a forming throat substantially tangential to the surface of the forming cylinder and thereafter run together over a segment of the surface of the forming cylinder to a run-off point where they leave the cylinder together, means for adjusting the tension in the wires, headbox means for injecting a jet of stock into the forming throat to be pressed between said wires to form a web therebetween with the discharge of liquid inwardly and outwardly of the forming cylinder, and save-all pan means positioned to collect liquid discharged outwardly, the improvement comprising means providing open, direct communication between the ambient atmosphere and the cylinder grooves contained in said cylinder segment, the adjoining space on the opposite side of the web and said save-all pan means such that part of the liquid in the web drains outwardly as the wires run over said peripheral segment and part is pressed inwardly into said cylindrical grooves with displacement of the air into the ambient atmosphere and is expelled from the grooves as the wires leave the forming cylinder, solely in response to forces resulting from translation and compression of the web by the forming wires as they are run around said cylinder segment, the grooves having sufficient volume to receive inwardly discharged liquid drained from the web with displacement of any air contained in the grooves, and to store such liquid until the wires with the web therebetween leave the forming cylinder at the run-off point where the stored liquid is expelled from the grooves, the forming cylinder having a radius such that for specified values of jet stock size, wire speed and wire tension, liquid drainage from the web inwardly and outwardly of the forming cylinder will be in relative amounts sufficient to avoid substantial two-sidedness in the web thus produced.

17. Apparatus as defined in claim 16 in which the outer wire, in running over the forming roll, subtends an angle between about $\Pi/2$ and $\Pi$ radians.

18. Apparatus as defined in claim 17 in which the wire supporting means includes means for causing the wires to run off the forming cylinder substantially in the vertical direction.

19. Apparatus as defined in claim 18 in which the wire supporting means includes means for causing the wires to run off the forming cylinder at a location in its lower descending quadrant.

20. Apparatus as defined in claim 18 in which the wire supporting means includes means for causing the wires to run off the forming cylinder at a location in its upper ascending quadrant.

21. Apparatus as defined in any one of claims 19 and 20 in which the wire supporting means include a break roll located away from the forming cylinder a short distance at least equal to the total thickness of the forming wires with the web therebetween, together with means for causing the wires to run over a peripheral segment of the break roll.

22. Apparatus as defined in claim 21 in which said segment subtends an angle of at least 1 radian, the break roll has a smooth surface and said wire supporting means include means for separating on the break roll the outer wire relative thereto from the web and the other wire at a separation angle not exceeding about 10°.

23. Apparatus as defined in claim 21 in which said segment subtends an angle of at least 1 radian, said wire supporting means include a smooth surfaced separation roll located on the opposite side of the wire web sandwich relative to the break roll, and means for separating on said separation roll the outer wire relative to the separation roll from the web and the other wire at a separation angle not exceeding about 10°.

24. Apparatus as defined in claim 22 in which the wire separation angle has a value between 1.5° and about 3°.

25. Apparatus as defined in claim 23 in which the wire separation angle has a value between about 1.5° and about 3°.

26. Apparatus as defined in claim 25 in which the separation roll is located on the opposite side of the wires relative to the break roll.

27. Apparatus as defined in claim 25 in which the separation roll is located on the same side of the wires as the break roll, together with first means for removing surface water from the outer wire at a location between said forming cylinder and the break roll, second means for removing surface water from the outer wire at a location between said break roll and said separation roll, and save-all pan means for collecting water removed by said first and second means.

28. Apparatus as defined in claim 21 in which the wire supporting means includes a second break roll spaced away from said first break roll in the direction of motion of the wires, a separation roll spaced away from said second break roll in the direction of motion of the web, means causing the wires to run over peripheral segments of said first and second break rolls subtending angles totaling at least about 1 radian, and means causing the outer wire relative to the separation roll to be separated on the separation roll from the web and the other wire at a separation angle not exceeding about 10°.

29. Apparatus as defined in claim 28 together with first means for removing surface water from the outer wire at a location between the forming cylinder and the first break roll, second means for removing surface water from the outer wire at a location between the first and second break rolls, third means for removing surface water from the outer web at a location between said second break roll and said separation roll, doctor means for removing surface water from said break rolls and separation roll, and save-all pan means for collecting water removed by said first, second and third water removing means and by said doctor means.

30. Apparatus as defined in claim 16 in which the wire supporting means includes a smooth surfaced roll on which the outer wire with respect thereto is separated from the web and the inner wire, said outer wire being a single layer wire of sufficiently fine mesh to hold in a portion thereof located immediately preceding the point of separation no larger quantity of water than can be absorbed on separation by an adjacent portion of the web, increased by the quantity that passes on separation from said wire portion through said web portion, while the other wire is capable of producing hydraulic contact between the web and the smooth surface on which separation takes place.

* * * * *

UNITED STATES PATENT AND TRADEMARK OFFICE

CERTIFICATE OF CORRECTION

PATENT NO. : 4,209,360

DATED : June 24, 1980

INVENTOR(S) : Erik G. Stenberg, Douglas Wahren, Carl Zotterman

It is certified that error appears in the above-identified patent and that said Letters Patent are hereby corrected as shown below:

Col. 1, line 36, "it" should read --It--.
Col. 1, line 65, "adhesive" should read --adhesion--.
Col. 2, line 12, "accordiang" should read --according--.
Col. 4, line 62, "in" should read --is--.
Col. 6, line 51, "subjject" should read --subject--.
Col. 9, line 7, "113" should read --133--.
Col. 10, line 54, " /2 and about radians" should read --π/2 and about π radians--.
Col. 13, line 22, "wound" should read --would--.

Signed and Sealed this

Thirtieth Day of September 1980

[SEAL]

Attest:

SIDNEY A. DIAMOND

Attesting Officer

Commissioner of Patents and Trademarks